United States Patent [19]

Biggs et al.

[11] 4,313,388

[45] Feb. 2, 1982

[54] MODULAR HOOK ASSEMBLY FOR STAGGERED NEEDLE CUT PILE TUFTING MACHINES

[75] Inventors: Aubrey H. Biggs, Chattanooga; Ian Slattery, Hixson; Jack G. Workman, Chattanooga, all of Tenn.

[73] Assignee: Spencer Wright Industries, Inc., Chattanooga, Tenn.

[21] Appl. No.: 156,913

[22] Filed: Jun. 6, 1980

[51] Int. Cl.[3] ..... D05C 15/00

[52] U.S. Cl. ..... 112/79 R

[58] Field of Search ..... 112/79 R, 79 FF, 79 A

[56] References Cited

U.S. PATENT DOCUMENTS

| | | | |
|---|---|---|---|
| 2,853,963 | 9/1958 | Hartstein | 112/79 R |
| 3,913,505 | 10/1975 | Crumbliss et al. | 112/79 R |
| 4,003,321 | 1/1977 | Card | 112/79 R |
| 4,193,359 | 3/1980 | Beasley | 112/79 R |
| 4,241,675 | 12/1980 | Bardsley | 112/79 A |

*Primary Examiner*—Ronald Feldbaum

*Attorney, Agent, or Firm*—Alan Ruderman

[57] ABSTRACT

A staggered cut pile tufting machine has a modular hook assembly having long blade hooks and short blade hooks molded in separate body members. The body members have complementary reference surfaces adapted to cooperatively mate and be secured together. One of the body members includes slots between the hooks carried therein for receiving a portion of the hooks of the other body member when assembled.

9 Claims, 8 Drawing Figures

MODULAR HOOK ASSEMBLY FOR STAGGERED NEEDLE CUT PILE TUFTING MACHINES

BACKGROUND OF THE INVENTION

This invention relates to tufting machine gauge parts, and more particularly to a modular hook assembly for staggered needle cut pile tufting machines.

In the production of tufted pile fabric each reciprocating needle cooperates with a loop or hook which seizes a loop of yarn from the needle and releases the loop to form loop pile fabric or holds the loop until it is cut by a knife acting in scissors-like fashion against the side of the hook to form cut pile fabric. The gauge of the pile fabric is determined by the spacing between adjacent gauge parts, i.e. the needles, hooks and knives, of the tufting machine. To produce fine gauge pile fabric, i.e. one tenth gauge and smaller, the spacing between adjacent gauge parts is 0.1 inch and smaller. As a consequence of the close spacing between the adjacent gauge part in fine gauge tufting machines, great difficulty has been experienced in providing hooks at the required spacing and maintaining the spacing. Moreover, in cut pile machines the transverse pressure applied to the individual hooks by the respective knives can give rise to deflection of the tips of the hooks. In view of the high accuracy required when the gauge parts are closely spaced it is highly desirable, if not mandatory, that this deflection be minimized to insure accurate and consistent seizing of the yarn hook from the cooperating needle. The conventional mounting of the hooks in corresponding slots in the hook bar and their securement by set screws creates difficulties in aligning closely spaced hooks and minimizing the deflections thereof. Furthermore, in the event of damage to a series of hooks or when such hooks are worn, the replacement of a new set is particularly demanding of time.

To overcome these problems it has been proposed to provide a hook module wherein the respective hook shanks are imbedded in a common body member in side-by-side disposition. Such constructions are illustrated in United Kingdom design registration Nos. 980,060 and 980,062. Such construction substantially eliminates the difficulties of aligning the hooks in the hook bar of the tufting machine since the hooks are aligned in a jig during the formation of the module and each body member may have an alignment surface for clamping of the module to a hook bar in the tufting machine.

Moreover, in fine gauge tufting machines it is known to locate the needles in staggered relationship in two rows and to mount cooperating hooks in a slotted hook bar, the hooks cooperating with the needles in one row having a longer bill than the hooks cooperating with the needles of the other row. For purposes of aligning the hooks in the hook bar, the throats of both the long billed set of hooks and the short bill set of hooks may be in alignment in the longitudinal direction of the hook bar, as illustrated in U.S. Pat. Nos. 4.003,321 and 3,913, 505. This, however, is unnecessary when hook modules are utilized. There does exist however the difficulty that in the event of damage to one hook in a module the entire module must be replaced, and similarly if knife pressure on one or the other sets of hooks is greater than on the other that set would have to be reground or replaced more frequently than the other set of hooks.

SUMMARY OF THE INVENTION

Consequently, it is a primary object of the present invention to provide a staggered hook module which improves the cost effectiveness of such modules by minimizing the extent to which components need be replaced when worn or damaged.

It is another object of the present invention to provide a staggered hook module for a staggered needle cut pile tufting machine wherein the long blade and short blade hooks are mounted in respective body parts adapted and arranged in such relative disposition that adjacent hooks are supported in a requisite disposition.

It is a further object of the present invention to provide a staggered hook module comprising respective body members for the long blade hooks and the short blade hooks each supporting a plurality of such hooks in side-by-side disposition thereon, the body members being adapted for mounting in such relative disposition that adjacent hooks are supported for cooperation with respective staggered needles in a tufting machine.

It is a still further object of the present invention to provide a staggered hook module comprising respective body members for the long blade hooks and the short blade hooks, each body member supporting a plurality of respective hooks, the body members being adapted and arranged to cooperate to locate the long blade hooks and the short blade hooks alternately in a requisite relationship.

In carrying out the invention there is provided a pair of body members each respectively supporting a series of hooks, one body member supporting long blade hooks and the other body member supporting short blade hooks. The body members have complementary reference surfaces adapted to co-operatively mate and means for securing the body members together, and when secured together a long blade hook is intermediate each short blade hook. The hooks may be molded into the respective body member to form standardized modules. When one or more of the long blade hooks, or the short blade hooks, are damaged, the body member carrying the damaged hooks only need be replaced. The modules, since the hooks can be assembled in a fixture, can have very accurate component precision. Thus, when the body members are secured together and mounted in a tufting machine, yarn seizure is precise and consistent. According to a preferred feature of the invention one of the body members has slots intermediate the hooks carried therein, and the hooks of the other body member are received in respective ones of the slots for added structural support of the latter hooks when the two body members are co-operatively mated.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
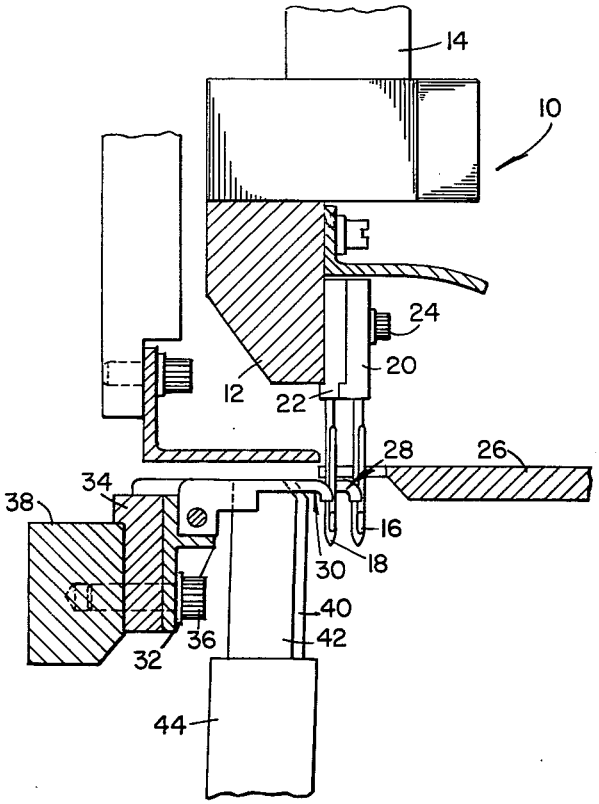
FIG. 1 is a diagrammatic side sectional elevation of a part of a tufting machine embodying a module constructed in accordance with the present invention.
Figure 4:
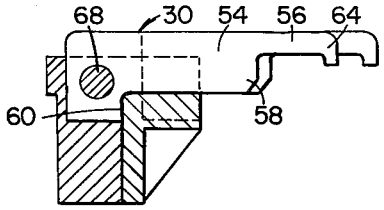
FIG. 4 is a side elevational cross sectional view taken substantially along line 4—4 of FIG. 3.
Figure 5:
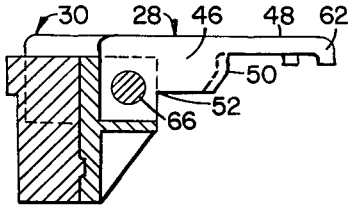
FIG. 5 is a side elevational cross sectional view taken substantially along line 5—5 of FIG. 3.
Figure 6:
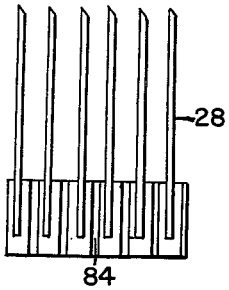
FIG. 6 is a top plan view of the front hook supporting module.
Figure 2:
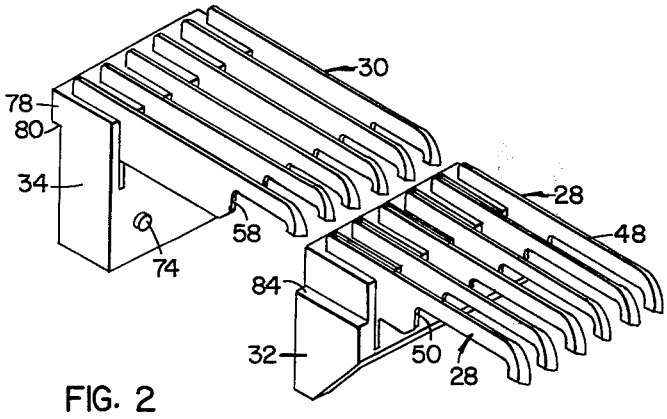
FIG. 2 is a disassembled perspective view of the two body members comprising the assembled hook module respectively carrying the long and short billed hooks.
Figure 7:
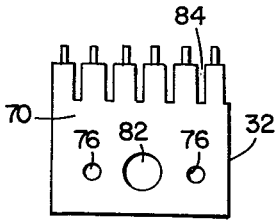
FIG. 7 is an end elevational view of the rear of the rear end face of the module of FIG. 5.
Figure 3:
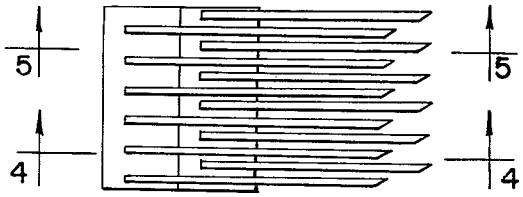
FIG. 3 is a top plan view of the assembled module.
Figure 8:
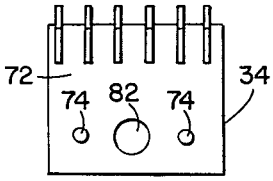
FIG. 8 is an end elevational view of the front face of the rear module.

Referring now to the drawings, and particularly to FIG. 1, the relevant portions of a tufting machine 10, are illustrated as including a needle bar 12 supported at the end of one or more push rods 14 driven axially reciprocably in conventional manner. Carried by the needle bar 12 arranged in rows disposed one behind the other and off set or staggered in the longitudinal direction of the needle bar is a plurality of needles 16,18 (only two of which are illustrated). The needles 16,18 may be arranged in modular units as disclosed in U.S. Pat. No. 4,138,956, assigned to the common assignee of the present invention. Thus, the needles 16 may be carried in a body member 20 while the needles 18 may be carried in a body member 22, the two body members having co-operating locating surfaces and being secured to the needle bar by a common screw 24. For a complete description of the needle modules reference may be had to the aforesaid U.S. Pat. No. 4,138,956.

Mounted in the bed of the tufting machine beneath the bed plate 26 is a plurality of front loopers or hooks 28 and a plurality of rear loopers or hooks 30, the hooks 28 co-operating with the needles 16, and the hooks 30 co-operating with the needles 18 to conventionally seize the loops of yarn presented by the respective needles. The hooks 28 and 30 are mounted in modular form, as hereinafter described, the hooks 28 being carried by a front body member 32 and the hooks 30 being carried by a rear body member 34, the two body members being clamped together and secured by screw means 36 to a hook bar 38. The hook bar may be oscillated conventionally to drive the hooks into co-operative relationship with the respective needle. The hooks 28,30 may also co-operate with respective knives 40 and 42 which may be carried by a common knife block 44 and oscillated in timed relationship with the oscillation of the hooks for co-acting with a face of the respective hooks in scissors-like manner for cutting the loops of yarn on the hooks to form cut pile.

Each hook 28 includes a substantially flat shank 46 having a stepped generally rectangular configuration, and a blade 48 extending forwardly from the shank in the plane thereof to define a throat 50 where the shank and blade join, the shank being further stepped at 52 rearwardly of the throat 50. Similarly the hook 30 includes a shank 54 and a blade 56 extending forwardly therefrom, the junction being stepped at 58 to define a throat, the shank having a further step 60 rearwardly of the throat 58. The blades 48 and 56 have at their leading free edges respective bills 62 and 64 which cooperate with the respective needles for seizing loops of yarn presented by the needles.

The hooks 28 are placed in a fixture with the throats 50 in substantial alignment with one another and with the bottom yarn engaging surfaces of the blades 48 in substantial planar alignment and the body member 32 is cast about the rear or mounting portion of the shanks. A through hole 66 is provided in each of the shanks 46 to receive liquid metal during the casting process, thereby to insure positive and permanent location of the hook within the body member 32. In a similar manner the hooks 30 are positioned in a fixture and the body member 34 cast about the mounting portion of the shanks 54, the liquid metal also being received within a hole 68 in the shank. The stepped portions 52,60 of the shanks aid in locating the hooks and provide a large surface for the metal of the body members to hug.

The body member 32 has a rear face 70 forming a substantially planar abutment surface against which a similar accurately formed planar surface 72 formed on the body member 34 is positioned when the body parts are assembled. The disposition of the surfaces relatively to the hooks being such that the bills of the hooks 28 are intermediate the bills of the hooks 30 and the bills are off set front to rear by the desired stagger of the tufting machine needle. The throats 50 and 58 may be aligned, or non-aligned as illustrated. One of the faces 70,72, for example, the face 72 may include one or more male formations 74 which may be in the form of a truncated conical protuberance while the other face 70 includes a like number of indentations or recesses 76 for receiving the protuberances. These male and female formations are provided in the mold so that they are accurately located on the respective faces of the body members; thus when the faces are in abutting relationship, the formations accurately align the body members one to the other in the plane of the surfaces. The body member 34 has a rear surface 78 rebated at 80 so as to form a step for accurate positioning the unit on a complementary surface of the hook bar 38, as illustrated. Each of the body members includes a substantially centrally disposed hole 82 through which the screw means 36 extends when the surfaces 70 and 72 are in abutment for securing and assembling the module to the hook bar 38.

The hooks 28 in the front body member 32 may be of conventional configuration while the hooks 30 of the rear body member 34 may be of an unconventional design to allow each hook 30 to be positioned intermediate adjacent hooks 28 of the front body member. However, in such a case the shanks of the hooks 30 would have an awkward configuration for the bottom yarn engaging surface of the blades and the bills to be properly disposed relatively to the blades and bills of the front module. To avoid such an unconventional design and to provide additional support for the elongated rear hooks 30, the invention proposes that the body members 32 be formed with slots 84 disposed intermediate the hooks 28 and of a depth substantially equal to the shank 54 between the throat 58 and the step 60. Thus, each hook 30 is received within a respective slot 84 when the body members 32 and 34 are assembled. The slot on one of the body member 32 may be open at that end for receiving the end hook of the member 34 and the slot is closed by the wall at the other end of the adjacent body member 32. With this construction the rear hooks 30 are not only positively secured within the body member 34, but are supported in the body member 32, thereby minimizing the amount of transverse deflection on these hooks and preventing excessive bending when engaged by their respective needles and knives.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. For example, the body members may be mounted one upon the other in which case the configuration of the hooks in one series would change accordingly. All such modifications which do not depart from the spirit of the invention are intended to be included within the scope of the appended claims.

Having thus set forth the nature of the invention what is claimed herein is:

1. A modular hook assembly for a staggered needle tufting machine having two transverse rows of spaced needles, the needles in one of the rows being staggered intermediate the needles in the other row, said assembly supporting a first series of hooks having a shank including a mounting portion at one end and a blade extending from the shank to define a throat therebetween and terminating at a bill for cooperation with the needles in one of said rows, and a second series of hooks having a shank including a mounting portion at one end and a blade extending from the shank to define a throat therebetween and terminating at a bill for cooperation with the needles in the other of said rows, said assembly comprising a first body member having means for receiving and securing the mounting portion of said first hooks in spaced side-by-side disposition, a second body member having means for receiving and securing the mounting portions of said second hooks in spaced side-by-side disposition, the spacing between the adjacent first hooks being substantially the same as the spacing between adjacent second hooks, said first and second body members having means defining complementary reference surfaces disposed relatively to the disposition of said first and second hooks for co-operative engagement of said body members and for location of the bills of said first hooks intermediate and spaced in the direction of said blades from the bills of the second hooks by the stagger of said needles, and means for securing said body members together as a unit in said co-operative engagement.

2. A modular hook assembly as recited in claim 1 wherein said first body member includes slots intermediate each of said first hooks for receiving a portion of the shank of respective ones of said second hooks when said body members are co-operatively engaged.

3. A modular hook assembly as recited in claim 1 wherein each of said first and second hooks comprises a planar blade surface intermediate the throat and the bill, the planar surfaces of the first hooks lying in a common plane with the planar surfaces of said second hooks when said body members are secured together.

4. A modular hook assembly as recited in claim 1 wherein said complementary reference surfaces include locating means comprising at least one male formation on one of said surfaces and at least one female formation on the other of said surfaces for cooperatively receiving said male formation.

5. A modular hook assembly as recited in claim 1 wherein the reference surface of said first body member is disposed on an end thereof facing oppositely to the direction of extension of the blades of the first hooks, and the reference surface of said second body member is disposed on an end thereof facing in the direction of extension of the blades of the second hooks.

6. A modular hook assembly as recited in claim 5 wherein said first body member includes slots intermediate each of said first hooks for receiving a portion of the shank of respective ones of said second hooks when said reference surfaces are in co-operative engagement.

7. A modular hook assembly as recited in claim 6 wherein said second body member includes a second reference surface on an end thereof facing oppositely to the direction of extension of the blades of the second hooks for mounting on a co-operating reference surface in a tufting machine.

8. A hook modular assembly as recited in claim 1 wherein said mounting portions of said first and second hooks include means for locating said portions in the respective body member.

9. A hook modular assembly as recited in claim 1 or 2 wherein said first and second hooks are molded into the respective body member.

* * * * *